US007064643B2

(12) United States Patent
Matsutani et al.

(10) Patent No.: US 7,064,643 B2
(45) Date of Patent: Jun. 20, 2006

(54) MULTI-PHASEMAGNETIC ELEMENT AND PRODUCTION METHOD THEREFOR

(75) Inventors: Nobuya Matsutani, Katano (JP); Hidenori Uematsu, Toyooka (JP); Tsunetsugu Imanishi, Toyooka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 8 days.

(21) Appl. No.: 10/488,965

(22) PCT Filed: Aug. 25, 2003

(86) PCT No.: PCT/JP03/10697

§ 371 (c)(1),
(2), (4) Date: Mar. 9, 2004

(87) PCT Pub. No.: WO2004/019352

PCT Pub. Date: Mar. 4, 2004

(65) Prior Publication Data

US 2004/0246084 A1 Dec. 9, 2004

(30) Foreign Application Priority Data

Aug. 26, 2002 (JP) ..... 2002-244732
Aug. 26, 2002 (JP) ..... 2002-244733

(51) Int. Cl.
*H01F 27/29* (2006.01)

(52) U.S. Cl. ..... 336/192

(58) Field of Classification Search ..... 336/65, 336/83, 192, 200, 233
See application file for complete search history.

(56) References Cited

U.S. PATENT DOCUMENTS

| | | | | |
|---|---|---|---|---|
| 4,502,982 | A * | 3/1985 | Horie et al. | 252/513 |
| 5,821,843 | A * | 10/1998 | Mamada et al. | 336/83 |
| 6,343,413 | B1 * | 2/2002 | Masuda et al. | 29/605 |
| 6,362,986 | B1 | 3/2002 | Schultz et al. | 363/132 |
| 6,888,435 | B1 * | 5/2005 | Inoue et al. | 336/83 |
| 2002/0067234 | A1 * | 6/2002 | Kung | 336/192 |

FOREIGN PATENT DOCUMENTS

| | | |
|---|---|---|
| JP | 54-163354 | 12/1979 |
| JP | 61-136213 | 6/1986 |
| JP | 1-266705 A | 10/1989 |
| JP | 3-171702 | 7/1991 |
| JP | 6-342714 | 12/1994 |
| JP | 8-37107 | 2/1996 |
| JP | 8-250333 | 9/1996 |
| JP | 8-264320 | 10/1996 |
| JP | 8-306541 | 11/1996 |
| JP | 9-125108 | 5/1997 |
| JP | 11-224817 | 8/1999 |
| JP | 2000-106312 | 4/2000 |
| JP | 2001-23822 | 1/2001 |
| JP | 2001-85237 | 3/2001 |
| JP | 2002-57039 | 2/2002 |
| JP | 2002-64027 | 2/2002 |
| JP | 2004-43131 | 2/2002 |
| JP | 2002-217416 | 8/2002 |

* cited by examiner

*Primary Examiner*—Tuyen T Nguyen
(74) *Attorney, Agent, or Firm*—Steptoe & Johnson LLP

(57) ABSTRACT

A magnetic element for multi-phase is composed by burying a plurality of coils in a composite magnetic material such that a negative coupling of magnetic fluxes or a positive coupling of magnetic fluxes exists between at least two coils. This structure more miniaturizes inductors, or choke coils as the multi-phase magnetic element suitably used for application of a large current to many kinds of electronic equipment. Such multi-phase magnetic element has an excellent ripple current property.

9 Claims, 7 Drawing Sheets

MULTI-PHASEMAGNETIC ELEMENT AND PRODUCTION METHOD THEREFOR

TECHNICAL FIELD

The present invention relates to a magnetic element used to such as an inductor or a choke coil of electronic equipment, and in particular to the magnetic element for multi-phase and a method of manufacturing the same.

BACKGROUND ART

In company with electronic equipment made miniaturized and in thin thickness, parts or devices used thereto are intensively demanded to be also small and thin size. On the other hand, LSI as CPU becomes highly integrated, and a power circuit supplied thereto is sometimes supplied with current of several amperes to several ten amperes. Accordingly, an inductor such as a choke coil used thereto is required to be small size as well as to have low resistance. That is, the inductor is necessary to less reduce inductance owing to DC superposed. To make resistance low, a coil conductor should have a large cross sectional area, but this is contrary to the reduction in size. Further, being much used at high frequency, the inductance is demanded for low loss at the high frequency. Lowering cost for parts are strongly requested, it is necessary to set up parts composing elements of simple shapes through a easy process. Namely, it is required to cheaply offer an inductor miniaturized to the most which are usable with a large current and at the high frequency. However, the high frequency and the large current of a switching frequency make the equipment difficult to be miniaturized and highly efficient, because a switching element increases losses or magnetism of the choke coil is saturated.

Therefore, recently, a circuit system called as a multi-phase system is adopted. For example, in a 4-phase system, four pieces of switching elements and four pieces of choke coils are used in parallel. In this circuit, for example, in case respective elements are driven at switching frequency of 500 kHz, DC superposed of 10 A, and the phase being 90° off, finally they apparently actuate at the driving frequency of 2 MHz and performance of DC superposed of 40 A, thereby to lower a ripple current. Thus, the multi-phase system is a power circuit system which can realize large current/high frequency having never existed.

As to the above mentioned circuit, it may be assumed to utilize the coil and a ferrite core of EE type or EI type most generally used. The ferrite material, however, has comparatively high permeability and lower saturated flux density in comparison with metallic magnetic materials. Therefore, if using the ferrite core as it is, the inductance largely drops owing the magnetic saturation, so that the property of DC superposed tends to be low. Therefore, for improving the property of DC superposed, the ferrite core is provided with a cavity at one portion in a magnetic path thereof for use by decreasing the apparent permeability. However, in this method, since the saturated flux density is low, the use at the large current is difficult. Having the cavity at one portion in the magnetic path of the ferrite core, it issues noisy beating in the ferrite core.

In addition, as the core material, it may be considered to employ Fe—Si—Al or Fe—Ni alloys having a larger saturated flux density than that of the ferrite. But these metallic materials have low electric resistance, so that eddy current loss is made large, and these metallic materials cannot be used as they are. Therefore, these materials should be made thin and laminated through insulating layers, but disadvantageously in cost.

In contrast, a dust core made by forming metallic magnetic particles has the extremely larger saturated flux density than that of a soft magnetic ferrite, and is excellent in the property of DC superposed. Therefore, the dust core is advantageous in preparing miniaturization, and any cavity is unnecessary and issues no beating. A core loss of the dust core consists of a hysteresis loss and the eddy current loss, and the eddy current loss increases in proportion to square of the frequency and square of the flowing size of the eddy current. Therefore, the metallic magnetic particle is covered on the surface with an electric insulation resin for suppressing occurrence of the eddy current. On the other hand, since the dust core is in general formed at pressure of more than several ton/cm$^2$, strain increases as a magnetic substance and permeability decreases, so that the hysteresis loss increases. For avoiding this, release of strain is proposed. For example, as disclosed in Japanese Patent Unexamined Publication No. H6-342714, the same No. H8-37107, and the same No. H9-125108, heat treatments after forming are performed.

For attaining a further miniaturization, built-in cores are also proposed, for instance, in Japanese Patent Unexamined Publication No. S54-163354 and the same No. S61-136213. These prior arts use cores with ferrite dispersed in resins.

However, in case a plurality of inductors are arranged in response to the number of multi-phases, not only installing spaces become large but also those are disadvantageous in cost. Since a plurality of cores used in the multi-phases have dispersions in inductance values, the ripple current property decreases and the efficiency of the power source also decreases.

DISCLOSURE OF THE INVENTION

In the multi-phase magnetic element of the present invention, a plurality of coils are buried in the composite magnetic material, and there are present a negative coupling of magnetic fluxes or a positive coupling of magnetic fluxes between at least two coils.

DETAILED DESCRIPTION OF PREFERRED EMBODIMENTS

Exemplary Embodiment 1

Figure 1:
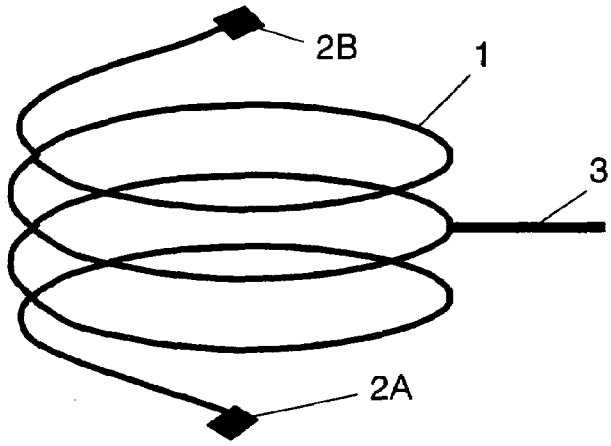
FIG. 1 is a schematic perspective view of a coil contained in a magnetic element in a first exemplary embodiment of the present invention.
Figure 2:
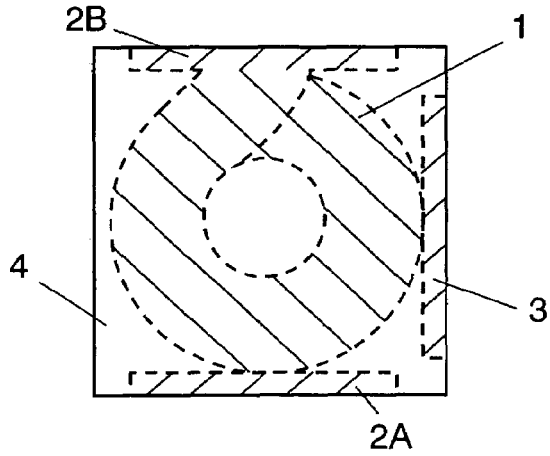
FIG. 2 is a see-through view of an upper surface of the magnetic element in the first exemplary embodiment of the present invention.
Figure 3:
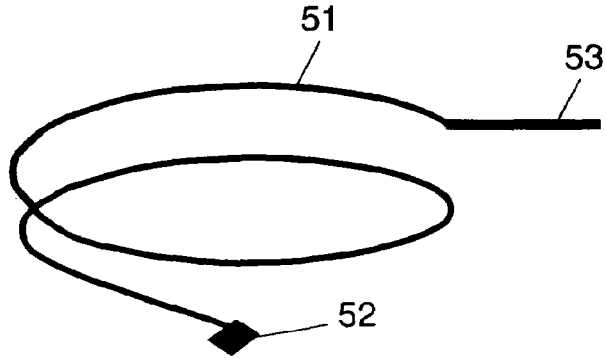
FIG. 3 PRIOR ART
FIG. 3 is a schematic perspective view of a coil contained in a magnetic element in a comparative example in a prior art.
Figure 4:
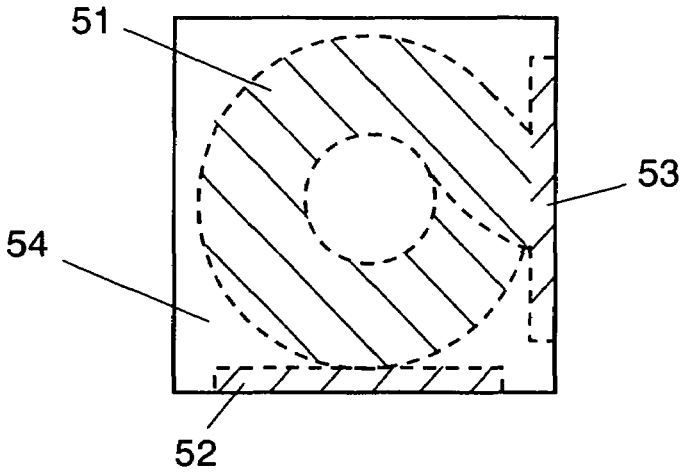
FIG. 4 PRIOR ART
FIG. 4 is the see-through view of an upper surface in the comparative example in the prior art.

FIG. 1 is the schematic perspective view of the coil for explaining a structure of the coil contained in the multi-phase magnetic element in the first exemplary embodiment of the present invention. FIG. 2 is the see-through view of the upper surface for explaining a structure of the magnetic element in the present embodiment. The magnetic element according to the present embodiment has a coil 1 and a composite magnetic material 4. The coil 1 has input terminals 2A, 2B and an output terminal 3. FIGS. 3 and 4 are the schematic perspective view of the coil and the see-through view of the upper surface of the magnetic element for explaining a shape of the coil and a structure of the magnetic element in the comparative examples of the prior art. The prior magnetic element has a coil 51 and a composite magnetic material 54. The coil 51 has an input terminal 52 and an output terminal 53.

Figure 5:
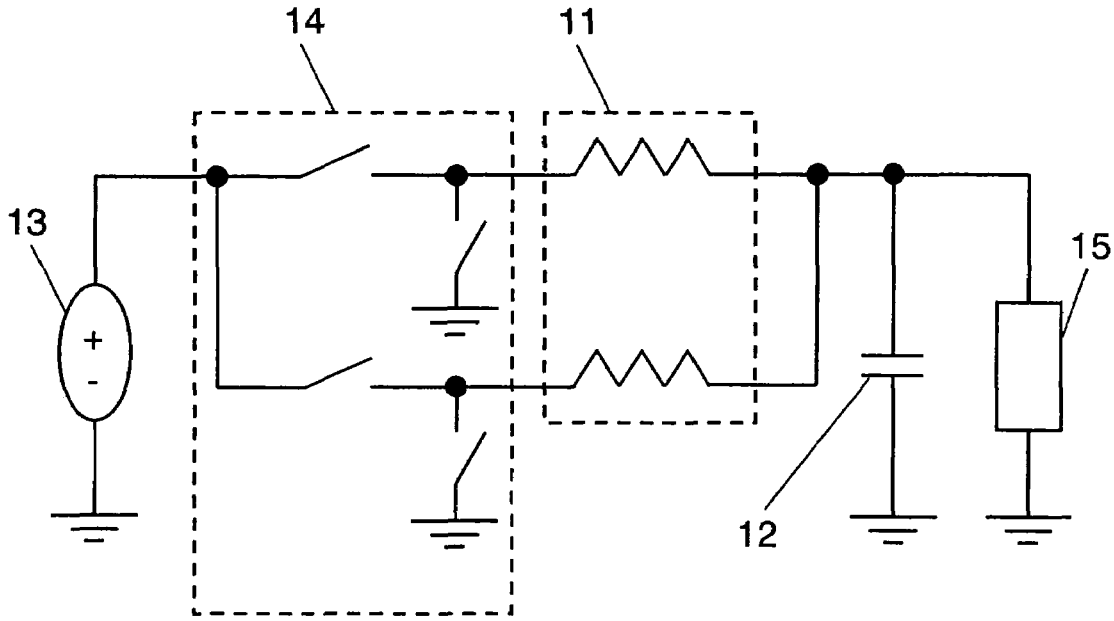
FIG. 5 is a power circuit of a multi-phase system.

The following description will explain a case of using the magnetic element according to the present embodiment as a choke coil in a circuit of the multi-phase system. FIG. 5 shows a power circuit using the multi-phase system, and this is a 2-phase system. This circuit (DC/DC converter) converts DC voltage of a battery 13 into an appointed DC voltage. A choke coil 11 and a capacitor 12 form an integration circuit. This circuit is connected with a switching element 14, and the power circuit is connected at an output with a load 15. In FIG. 1, the coil of 3.5 turns has the output terminal 3 just at 1.75 turns being the coil center. The two input terminals 2A, 2B of the coil 1 are respectively connected to the switching element 14 of FIG. 5. In such a way, the coil 1 serves by itself as two choke coils in common having the output terminal 3. An electric current flows from the respective input terminals 2A, 2B to the output terminal 3. Since DC magnetic fluxes passing through both coil ends are made reverse each other by this current, a magnetic field at the coil is as a whole weakened. In the following description, an arrangement where the DC magnetic flux passing through the coil center weaken each other will be called as a negative coupling of magnetic fluxes. Reversely, an arrangement where the DC magnetic fluxes passing through the coil center strengthen each other will be called as a positive coupling of magnetic fluxes. The positive and negative couplings of the magnetic fluxes are varied in dependence on the arrangement of the coils, the turning direction of the coils, or the flowing direction of current.

The following description will state the specific structure of the magnetic element and properties thereof in the present embodiment comparing with the prior art. A first reference will be made to a method of producing the magnetic element in this embodiment. As a raw material of the composite magnetic material 4, soft magnetic alloy particles of iron (Fe) and nickel (Ni) of average diameter being 13 μm made by a water atomizer method are prepared. The alloying compositions are 50 weight % respectively in Fe and Ni. Then, as an insulation binding agent, a silicone resin is added by 0.033 weight ratio to the above alloying particles, sufficiently mixed, and passed through a mesh to turn out regular particles. Next, a punched copper plate is used for preparing the coil 1 of 4.2 mm inner diameter and 3.5 turns having the output terminal 3 at its intermediate portion. At this time, the thickness of the coil 1 is changed to adjust to have direct current resistance values (Rdc) of Table 1. Subsequently, the regular particles and the coil 1 are charged in a metal mold (not shown) and pressed into a shape at 3 ton/cm$^2$. Further, the product is taken out from the mold, followed by performing a heat treatment at 150° C. for 1 hour and hardening. Thus, burying the coil in the composite magnetic material of the soft magnetic alloying particles and the insulation binding agent, insulation and withstand voltage are in particular maintained between the core and the coil.

Thus, as shown in FIG. 2, the 2-phase magnetic element of 10 mm H×10 mm L×4 mm T is provided, which stores two inductor coils, and has the input terminals 2A, 2B and the output terminal 3. For comparison, by use of the copper plate punched similarly as mentioned above, the coil of the 4.2 mm inner diameter and the 1.75 turns is prepared as shown in FIG. 3. This coil is so adjusted to be Rdc of Table 1 by varying the coil thickness. Next, in the same manner as the present embodiment, the magnetic elements shown in FIG. 4 of 10 mm H×10 mm L×3 mm T are prepared two in total, each storing one coil therein. Namely, a composite magnetic material 54 has the same structure as that of the composite magnetic material 4. As to the inductance values of these magnetic elements, any of the coils have inductance of 0.25 to 0.26 μH in DC value of I=OA.

The evaluated results of these magnetic elements are shown in Table 1.

TABLE 1

| Sample No. | DC resistant value Rdc (Ω) | Coupling | Maximum current value (A) | Efficiency (%) |
|---|---|---|---|---|
| 1 | 0.002 | Negative | 40 | 92 |
| 2 | 0.01 | Negative | 40 | 90 |
| 3 | 0.05 | Negative | 42 | 86 |
| 4 | 0.06 | Negative | 43 | 83 |
| 5 | 0.01 | Naught | 18 | 88 |

Table 1 shows the power supply efficiency when driving in the 2-phase circuit system, using the above mentioned magnetic elements, at the frequency of 400 kHz per one inductor coil and 20 A of DC superposed. The samples Nos. 1 to 4 are the structures of the present embodiment, and No. 5 is the structure of the comparative example.

The ripple current rate is a rate of the ripple current to the current of DC superposed, the choke coil is more excellent as it coming near to zero, which means that a smoothing effect is large. In the samples Nos. 1 to 4, the ripple current rates fall in the range between 0.8 and 1.5%. The maximum current value signifies the DC values when the inductance value L at the current value of I=OA decreases by 20%.

As apparently from the results of Table 1, the structure of burying the two inductors with existence of a negative coupling of the magnetic fluxes shows more excellent property of DC superposed than that of using two pieces of sole choke coils without the coupling shown in FIG. 4. In addition, each of the inductors realizes the efficiency of at least 85% in case of Rdc≦0.05 Ω, and the efficiency of at least 90% in case of Rdc≦0.01 Ω. By suppressing Rdc as the above way, a miniaturized multi-phase magnetic element with less loss of the coil part (Copper loss) is obtained.

There is conventionally a chip array storing therein a plurality of coils, as disclosed in, for example, Japanese Patent Unexamined Publication Nos. H8-264320 and 2001-85237. These disclosed chip arrays have main objects in removing noises at signal level, and the large current (more than 1 A, desirably more than 5 A) as the DC superposed of the present embodiment is substantially different in the usage from the choke coils. Other conventional chip arrays are also disclosed in Japanese Patent Unexamined Publication Nos. H8-306541 and 2001-23822, in which sintered ferrites are wound with a plurality of coils, or the heat treatment is finally carried out at higher than 600° C. for burying the coils in the sintered ferrite. Even if these techniques are applied to use of the large current, since the sintered ferrite is low in the saturated magnetic flux density, a value of the inductor at the time of DC superposed is too low to use it. On the other hand, in the present embodiment, magnetic particles of the metallic particles are used as the composite magnetic material 4. Since the magnetic element according to the embodiment is used as the multi-phase choke coil used to the power source where the large current flows, the driving frequency per one element is at least 50 kHz and at most 10 MHz, desirably at least 100 kHz and at most 5 MHz. As is seen, the magnetic element of the embodiment is largely different in the driving frequency from the conventional chip arrays.

Further, as disclosed in Japanese Patent Unexamined Publication Nos. H8-250333 and H11-224817, the conventional chip arrays exclude the most crosstalk between the neighboring coils. In contrast, the present embodiment adopts positively the negative coupling of the magnetic fluxes between at least two neighboring inductances. Also in this point, the magnetic element is largely different from the conventional chip array. That is, in the present embodiment, the larger is the coupling coefficient k showing the coupling between the inductors, in other words, the nearer to 1 is k, the more preferable is the coupling, and even if the coupling coefficient is at least 0.05, an effect is recognized, but desirably at least 0.15.

If designing the DC input directions for the plural inductors or the coil winding direction, and if coupling the magnetic fluxes negative to the neighboring inductors, the DC magnetic fields occurring at the centers of the respective inductors negate one another. Therefore, the magnetic substance is not easily saturated even at the large current. The structure of the present embodiment can prevent the magnetic flux from saturation, and is at the same time better in the property of the DC superposed than using the two inductors of the same number of turns. Thus, such a choke coil is provided which is low in the DC resistance value, small in installing space, and desirable to the multi-phase.

In the buried inductors, the negative coupling of the magnetic fluxes is desirable for lowering the ripple current with only DC magnetic fields between at least two neighboring inductors, while AC magnetic fields are not coupled. It is therefore also sufficient to introduce a short ring which couples with the DC magnetic fields between the neighboring inductors, but can cancel the AC magnetic fields.

By the structure in FIGS. 1 and 2, the two inductors showing the negative coupling can be easily realized from one coil.

If using the terminals 2A, 2B as an input terminal and an output terminal while leaving the terminal 3 opened, it is possible to deal with the structure as one inductor having a large inductance value. FIG. 1 is one example, and the structure is not limited thereto.

Generally, since dispersions (inductance value) between cores of the magnetic element are nearly ±20%, in case a plurality of cores are used for the multi-phase, the ripple current value probably increases. In the present embodiment, a plurality of inductances are buried in one magnetic substance. Such a structure can control dispersions of the inductance values in the magnetic substance to be small, and consequently, the ripple current value is decreased.

In regard to the present embodiment, explanation is made to the 2-phase magnetic element, but no limitation is made to the 2-phase, and similar effects are also available in the multi-phase magnetic element. For example, if providing input terminals at both ends of one coil and at the center of its turns, and providing output terminals at the intermediate portion of the input terminals, a 4-phase magnetic element is available.

Exemplary Embodiment 2

Figure 6:
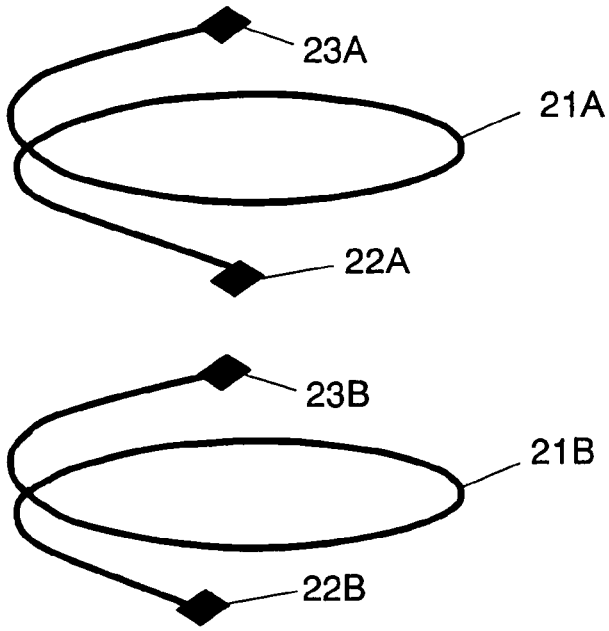
FIG. 6 is a schematic perspective view of upper and lower coils of a magnetic element in a second exemplary embodiment of the present invention.
Figure 7A:
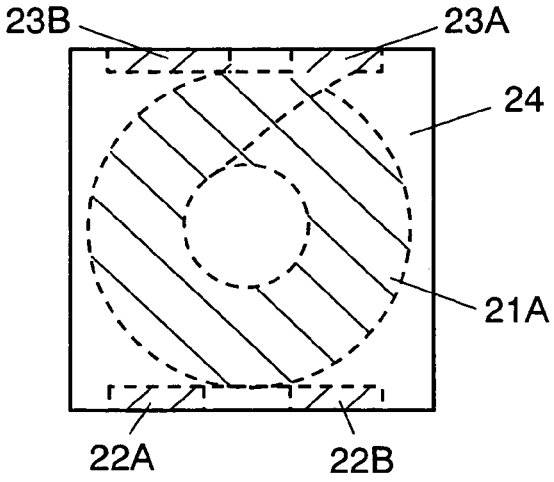
FIG. 7A is the see-through view of an upper surface of the magnetic element in the second exemplary embodiment of the present invention.
Figure 7B:
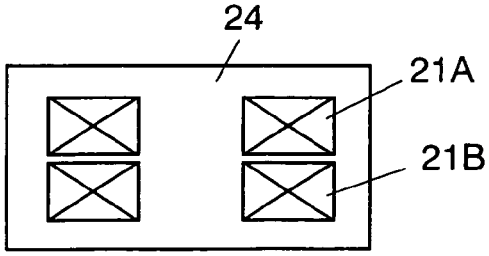
FIG. 7B is a cross sectional view of the magnetic element of FIG. 7A.
Figure 8:
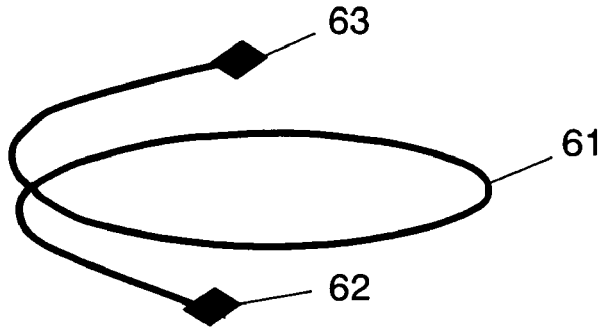
FIG. 8 PRIOR ART
FIG. 8 is a schematic perspective view of a coil contained in a magnetic element in a comparative example in a prior art.
Figure 9A:
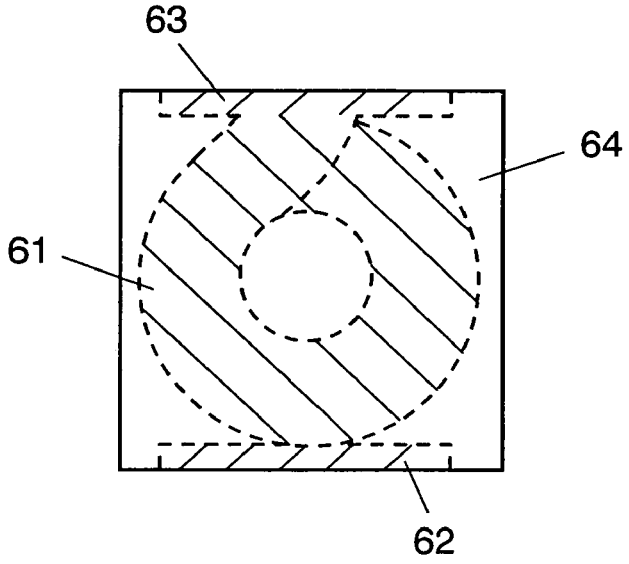
FIG. 9A PRIOR ART
FIG. 9A is a see-through view of an upper surface of the magnetic element in the comparative example according to the prior art.
Figure 9B:
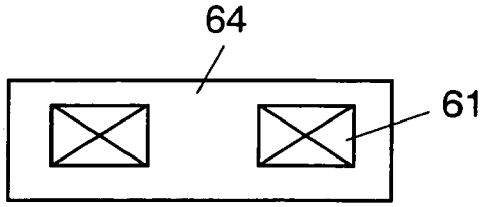
FIG. 9B PRIOR ART
FIG. 9B is a cross sectional view of the magnetic element of FIG. 9A.

FIG. 6 is the schematic perspective views of the coils for explaining the coil structure contained in the multi-phase magnetic element in the second exemplary embodiment of the present invention. FIGS. 7A, 7B are respectively the see-through view of the upper surface of the magnetic element and the cross sectional view of the same for explaining the magnetic element in the present embodiment. The magnetic element according to the present embodiment has an upper coil 21A, a lower coil 21B and a composite magnetic material 24. The upper coil 21A and the lower coil 21B have respectively input terminals 22A, 22B and output terminals 23A, 23B. FIG. 8 is the schematic perspective view of the coil for explaining a structure of the coil contained in the multi-phase magnetic element in the comparative examples of the prior art. FIGS. 9A, 9B are respectively the see-through view of the upper surface of the magnetic element and the cross sectional view of the same for explaining the structure of the magnetic element in the comparative examples. The prior magnetic element has a coil 61 and a composite magnetic material 64, and the coil 61 has an input terminal 62 and an output terminal 63.

The following description will explain a case of using the magnetic element according to the present embodiment as a choke coil within a circuit of the multi-phase system shown in FIG. 5. In FIG. 6, the magnetic element according to the present embodiment is structured by vertically laminating the coils of 1.5 turns. In short, the input terminals 22A, 22B provided in the coils 21A, 21B are connected to the switching element 14 in FIG. 5, respectively. The electric current flows from the input terminal 22A to the output terminal 23A, and from the input terminal 22B to the output terminal 23B. Since DC magnetic fluxes passing through both coil ends direct in the same direction each other by this current, a magnetic field of the coil is strengthened consequently. That is, since the DC magnetic fluxes passing through the centers of the neighboring coils are arranged to strengthen each other, this is the positive coupling of the magnetic fluxes.

The following description will state the specific structure of the magnetic element and properties thereof in the present embodiment comparing with the prior art.

A reference will be made to a method of producing the magnetic element in this embodiment. As a raw material of the composite magnetic material 24, soft magnetic alloy particles of iron (Fe) and nickel (Ni) of average diameter being 17 μm made by a water atomizer method are prepared. The alloying compositions are Fe of 60 weight % and Ni of 40 weight %. Then, as an insulation binding agent, a silicone resin is added by 0.032 weight ratio to the above alloying particles, sufficiently mixed, and passed through a mesh to turn out regular particles. Next, the punched copper plate is used for preparing the coils 21A, 21B of 3.7 mm inner diameter and 1.5 turns. At this time, the thicknesses of the coils 21A, 21B are changed to adjust to have direct current resistance values (Rdc) of Table 2. Subsequently, the regular particles and the coil 21A, 21B laminated vertically and in the same turning direction are charged in the metal mold (not shown) and pressed into a shape at 4 ton/cm$^2$. Further, the product is taken out from the mold, followed by performing a heat treatment at 150° C. for 1 hour and hardening.

Thus, setting up the coils 21A, 21B vertically as shown in FIG. 7, the 2-phase magnetic element is provided, which stores the two inductor coils therein and is 10 mm H×10 mm L×4 mm T. For comparison, by use of the copper plate punched similarly as mentioned above, the coil of the 3.7 mm inner diameter and the 1.5 turns is prepared as shown in FIG. 8. This coil is so adjusted to be Rdc of Table 2 by varying the coil thickness. Next, in the same manner as the present embodiment, the magnetic elements of 10 mm H×10 mm L×3 mm T shown in FIGS. 9A, 9B are prepared two in total, storing one coil therein. Namely, the composite magnetic material 64 has the same structure as that of the composite magnetic material 24. As to the inductance values of these magnetic elements, any of the coils have inductance of 0.22 to 0.23 μH in DC value of I=OA.

The evaluated results of these magnetic elements are shown in Table 2. Table 2 shows the ripple current rates when driving in the 2-phase circuit system, using the above mentioned magnetic elements, at the frequency of 450 kHz per one inductor coil and 15 A of DC superposed. The ripple current rate is the rate of the ripple current to the current of DC superposed, the choke coil is more excellent as it coming near to zero, which means that a smoothing effect is large. The maximum current value signifies the DC values when the inductance value L at the current value of I=OA decreases by 20%. In all the samples, the maximum current value ranges 16 to 34 A. The samples 6 to 9 are the structures according to the present embodiment, while the sample 10 is the structure of the comparative example.

TABLE 2

| Sample No. | DC resistant value Rdc (Ω) | Coupling | Ripple current (%) | Efficiency (%) |
|---|---|---|---|---|
| 6 | 0.002 | Positive | 0.8 | 92 |
| 7 | 0.01 | Positive | 0.8 | 90 |
| 8 | 0.05 | Positive | 0.7 | 87 |
| 9 | 0.06 | Positive | 0.5 | 83 |
| 10 | 0.01 | Naught | 3.0 | 90 |

As apparently from Table 2, the structures of the samples 6 to 9 with the two inductors buried with existence of the positive coupling of the magnetic fluxes show more excellent ripple current properties than the sample 10 using two pieces of sole choke coils without the coupling shown in FIG. 9.

In addition, each of the inductors realizes the efficiency of at least 85% in case of Rdc≦0.05 Ω, and the efficiency of at least 90% in case of Rdc≦0.01 Ω.

Further, the larger is the coupling coefficient k showing the coupling between the inductors, in other words, the nearer to 1 is k, the more preferable is the coupling. Even if the coupling coefficient is at least 0.05, an effect is recognized, but desirably it is at least 0.15.

If designing the current input directions for the plural inductors or the coil winding directions, and making the positive coupling of the magnetic fluxes of the neighboring coils, the inductance values increase and the excellent ripple current properties are provided. Namely, the choke coil property is varied depending on the positive or the negative coupling of the magnetic fluxes of the neighboring coils. The negative coupling of the magnetic fluxes is more excellent in the property of DC superposed as in the first embodiment, and the positive coupling of the magnetic fluxes is more excellent in the ripple current property as in the present embodiment. It is sufficient to appropriately use the negative coupling or the positive coupling in response to the circuit or the purpose of the electronic equipment.

Generally, since dispersions (inductance value) between the cores of the magnetic element are nearly ±20%, in case a plurality of cores are used for the multi-phase, the ripple current value probably increases. In the present embodiment, a plurality of inductances are buried in one magnetic substance. Besides, the magnetic fluxes of the neighboring coils are structured to provide the positive coupling. Such a structure can control dispersions of the inductance values in the magnetic substance to be smaller in comparison with the first embodiment, and the ripple current value is decreased.

In regard to the present embodiment, explanation is made to the 2-phase magnetic element, but no limitation is made to the 2-phase, and similar effects are also available in the multi-phase magnetic element. For example, if vertically laminating three coils in the same turning direction and burying them in one composite magnetic material, a 3-phase magnetic element is available.

Exemplary Embodiment 3

Figure 10:
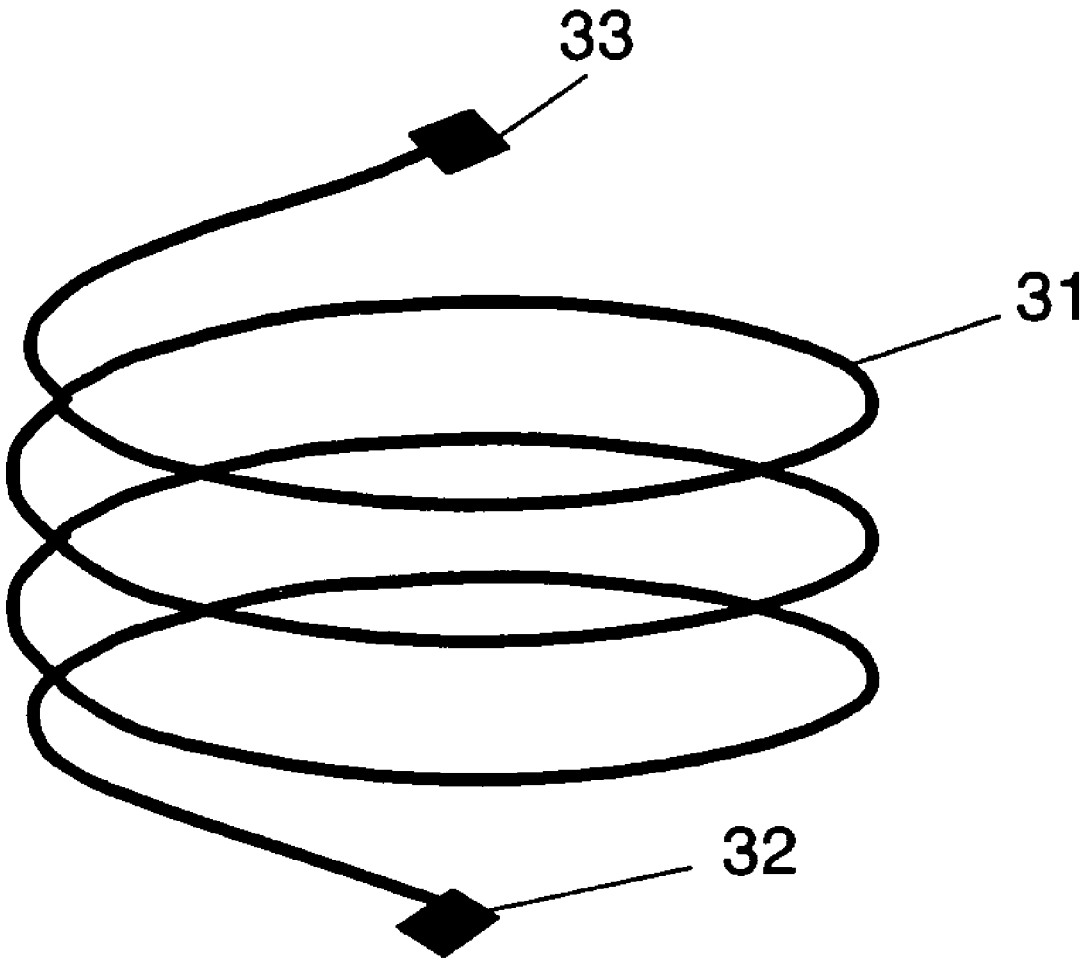
FIG. 10 is a schematic perspective view of a coil contained in the magnetic element in a third exemplary embodiment of the present invention.
Figure 11:
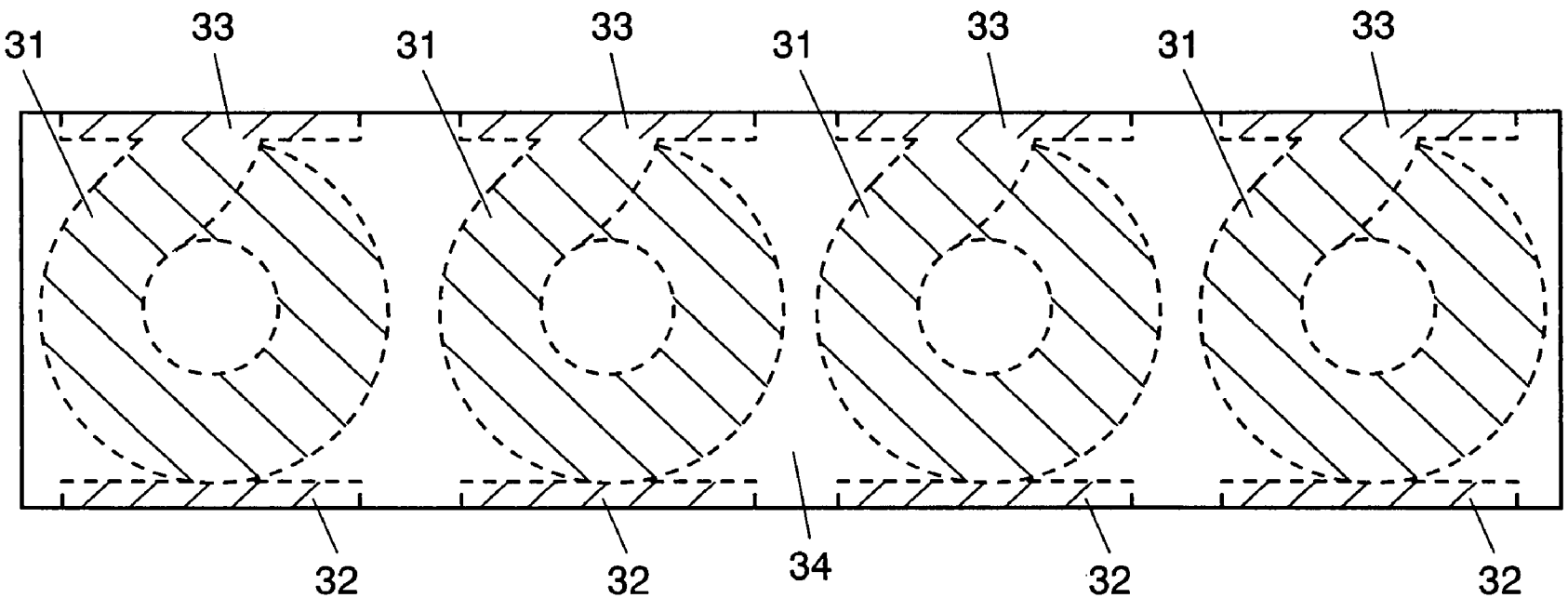
FIG. 11 is a see-through view of an upper surface of the magnetic element in the third exemplary embodiment of the present invention.

FIG. 11 is the see-through view of the upper surface of the magnetic element in the third exemplary embodiment of the present invention. FIG. 10 is the schematic perspective view of each coil contained in the magnetic element in FIG. 11. The coil 31 has an input terminal 32 and an output terminal 33. In FIG. 11, since a plurality of neighboring coils 31 direct in the same turning direction, the magnetic flux flows to have the negative coupling in the coil centers of the respective neighboring coils buried in a composite magnetic material 34. Such a structure brings about the miniaturized multi-phase magnetic element having especially excellent property of DC superposed.

The following description will state the specific structure of the magnetic element and properties thereof. The present embodiment employs, as a raw material of the composite magnetic material 34, ingot pulverized particles composed of the metallic magnetic particles having compositions shown in Table 3. Then, as an insulation binding agent, a bisphenol A type resin is added by 0.03 weight ratio to the above pulverized particles, sufficiently mixed, and passed through a mesh to turn out regular particles. Next, the punched copper plate is used for preparing the coil 31 of 2.2 mm inner diameter and 3.5 turns. At this time, the thickness of the coil 31 is changed to adjust direct current resistance values (Rdc) to be 0.01 Ω. Subsequently, the regular particles and the four coils 31 are charged in the metal mold (not shown) in the same turning direction, and pressed into a shape at 3 to 5 ton/cm$^2$. Herein, each of inductors is made 0.12 to 0.17 μH at the current value I=OA in a final product. Further, the product is taken out from the mold, followed by performing a heat treatment at 120° C. for 1 hour and hardening.

Thus, as shown in FIG. 11, the 4-phase magnetic element of 6.5 mm H×26 mm L×4 mm T is provided, which stores four inductor coils therein. In the sample No. 25, since the magnetic particle diameter is 0.8 μm, the inductance value is only 0.1 μH at the current value I=OA.

The evaluated results of these magnetic elements are shown in Table 3. In table 3, the column of the magnetic particle composition shows the respective elements and their weight %, and the weight % of Fe is found by subtracting the sum of weight % of the other element(s) from 100%.

Table 3 shows the power supply efficiency when driving in the 4-phase circuit system, using the above mentioned magnetic element, at the driving frequency of 1 MHz per one inductor coil and 15 A of DC superposed. The maximum current value signifies the DC values when the inductance value L at the current value of I=OA decreases by 20%.

TABLE 3

| Sample No. | Composition of magnetic particle | Particle size (μm) | Maximum current value (A) | Efficiency (%) |
|---|---|---|---|---|
| 11 | Fe | 10 | 30 | 90 |
| 12 | Fe-0.5Si | 10 | 30 | 91 |
| 13 | Fe-3.5Si | 10 | 26 | 91 |
| 14 | Fe-6Si | 10 | 24 | 93 |
| 15 | Fe—Fe9.5Si | 10 | 20 | 90 |
| 16 | Fe-10Si | 10 | 14 | 90 |
| 17 | Fe-50Si | 10 | 26 | 91 |
| 18 | Fe-80Si | 10 | 20 | 93 |
| 19 | Fe-3Al | 10 | 26 | 91 |
| 20 | Fe-4Al-5Si | 10 | 18 | 90 |
| 21 | Fe-5Al-10Si | 10 | 13 | 91 |
| 22 | Fe-45Ni-25Co | 10 | 19 | 92 |
| 23 | Fe-2V-49Co | 10 | 31 | 93 |
| 24 | MnZn ferrite | 10 | 8 | 87 |
| 25 | Fe-4.5Si-4.5Cr | 0.8 | 27 | 84 |
| 26 | Fe-4.5Si-4.5Cr | 1 | 25 | 93 |
| 27 | Fe-4.5Si-4.5Cr | 10 | 24 | 92 |
| 28 | Fe-4.5Si-4.5Cr | 50 | 22 | 90 |
| 29 | Fe-4.5Si-4.5Cr | 100 | 20 | 85 |
| 30 | Fe-4.5Si-4.5Cr | 110 | 18 | 83 |

As apparently from Table 3, when the composition of the magnetic particles consisting of the soft magnetic alloy contains Fe, Ni and Co is at least 90 weight % in total, the maximum current value shows at least 15 A. Because, if containing Fe, Ni and Co more than 90 weight % in total, a highly saturated magnetic flux density and a highly permeability can be realized.

As shown in Table 3, when the magnetic particle diameter is at most 100 μm, the efficiency is at least 85%, and further when being at most 50 μm, the efficiency is at least 90%. This is because if making the average diameter of the soft magnetic particles at most 100 μm, it is effective for decreasing an eddy current. It is more preferable that an average diameter of the soft magnetic particles is at most 50 μm. In addition, if the average diameter is less than 1 μm, a forming density is small, and the inductance value undesirably goes down.

Still further explanation will be made to a method of producing the magnetic element according to the present embodiment. At first, a non-hardened thermosetting resin is mixed with the soft magnetic alloy particles. Next, this mixture is made granular. It is sufficient to use the metal magnetic particles mixed with the resin component as it is and processed in a subsequent forming process, but if once passing through a mesh to be regular particles, since fluidity of the particle heightens, the metal magnetic particles are ready for handling.

Next, the granules are put into the mold together with the coils of at least two, and press-formed to have an objective filling factor of the metal magnetic particles. At this time, the neighboring coils direct in the same winding direction. Meanwhile, if heightening the pressure for heightening the filling factor, the saturated magnetic flux density and the permeability become high, but the insulation resistance and the withstand voltage are easy to go down. Further, a residual stress depending on the magnetic substance becomes large and the magnetic loss increases. On the other hand, if the filling factor is too low, the saturated magnetic flux density and the permeability are low, so that the inductance value or the property of DC superposed are not sufficiently available. In addition, taking a life of the mold into consideration, the pressure at press-forming is 1 to 5 ton/cm$^2$, more desirably 2 to 4 ton/cm$^2$.

Next, the formed body is heated to harden the thermosetting resin. Here, if increasing a temperature to the resin hardening temperature while press-forming in the metal mold, an electric resistivity is easily heightened. But in this method, productivity is low, and therefore, the press-forming may be carried out at a room temperature, followed by heat-hardening. In such a manner, the multi-phase magnetic element is provided.

Besides, for supplying to CPU, it is preferable that the input terminal and the output terminal of the multi-phase magnetic element are arranged at degree of at least than 80°.

In regard to the present embodiment, explanation is made to the 4-phase magnetic element, but no limitation is made to the 4-phase, but the 2-phase magnetic element storing two coils therein brings about the similar effects to the multi-phase magnetic element.

Exemplary Embodiment 4

Figure 12A:
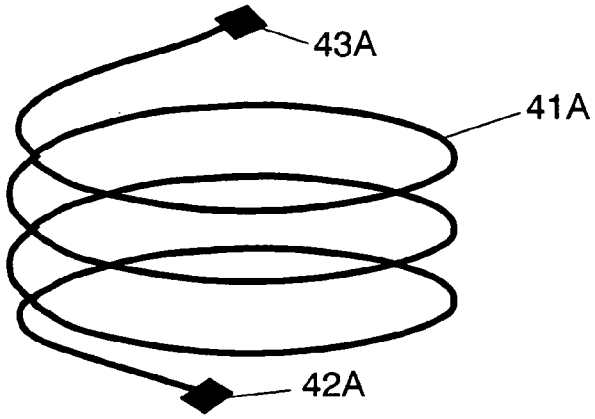
FIG. 12A is a schematic perspective view of a coil contained in a magnetic element in a fourth exemplary embodiment of the present invention.
Figure 12B:
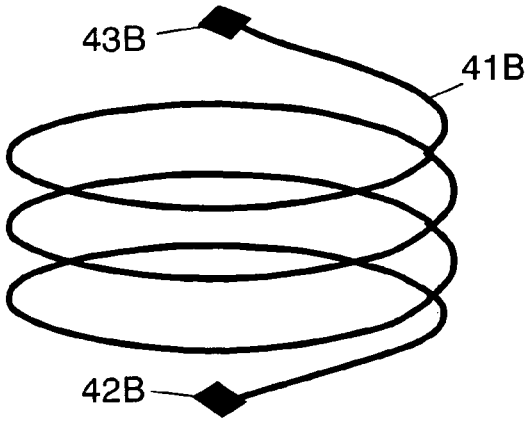
FIG. 12B is a schematic perspective view of a coil neighboring the coil of FIG. 12A.
Figure 13:
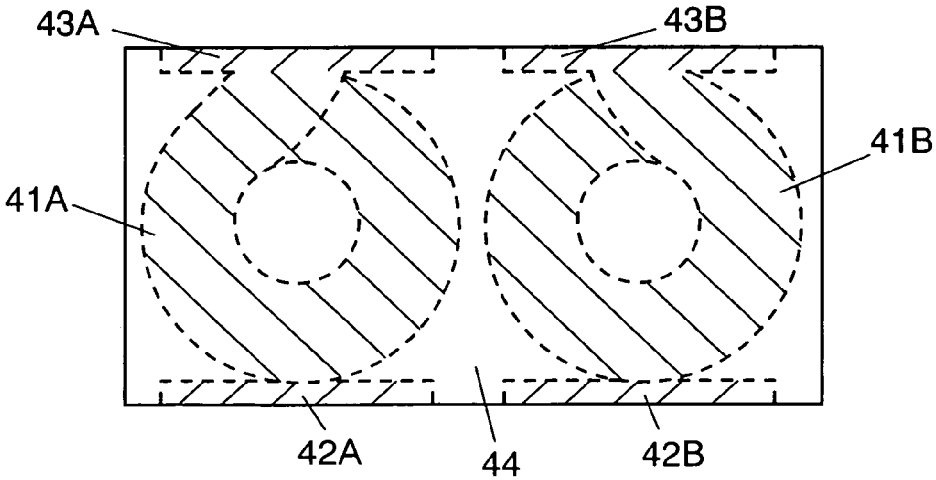
FIG. 13 is a see-through view of an upper surface of the magnetic element in the fourth exemplary embodiment of the present invention.

FIG. 13 is the see-through view of the upper surface of the magnetic element in the fourth exemplary embodiment of the present invention. FIG. 12 is the schematic perspective views of the coils contained in the magnetic element in FIG. 13. Coils 41A, 41B have input terminals 42A, 42B and output terminals 43A, 43B, respectively. In FIG. 13, the two neighboring coils 41A, 41B have the same number of turns, but the turning directions are reverse. Accordingly, the magnetic fluxes flow to have the positive coupling respectively through the centers of the neighboring coils. The coils 41A, 41B are buried in the composite magnetic material 44. Such a structure realizes the miniaturized multi-phase magnetic element having especially excellent property of the ripple current.

The following description will state the specific structure of the magnetic element and properties thereof. The present embodiment employs, as a raw material of the composite magnetic material 44, Fe—Si soft magnetic alloying particles of average diameter being 20 μm made by a gas atomizer method. The weight ratio of Fe and Si is 0.965: 0.035. Then, as the insulation binding agent, the silicone resin is added by 0.02 to 0.04 weight ratio to the above alloy particles, sufficiently mixed, and passed through a mesh to turn out regular particles.

Next, the punched copper plate is used for preparing the coils 41A, 41B of 3.3 mm inner diameter and 3.5 turns. At this time, the thicknesses of the coils 41A, 41B are changed to adjust the direct current resistance values (Rdc) to be 0.02 Ω. Subsequently, the regular particles and the coils 41A, 41B are charged in the metal mold (not shown) in the reverse turning directions for pressure-forming. Then, the pressure is adjusted at the range between 0.5 and 7 ton/cm$^2$ in order to have the filling factors shown in Table 4. Further, the formed product is taken out from the mold, followed by performing the heat treatment at 150° C. for 1 hour and hardening.

Thus, as shown in FIG. 13, the 2-phase magnetic element of 10 mm H×20 mm L×4 mm T is provided, which stores two inductors therein.

As shown in FIG. 13, the turning directions of the neighboring coils 41A, 41B are reverse, showing the positive coupling of the magnetic fluxes. The inductance values at this time, are 0.25 to 0.28 μH of the inductance coils of the samples Nos. 32 to 36 at the current values of I=OA, and the inductance value of the sample No. 31 is 0.22 μH.

Further, as samples without burying any coil for measuring insulation resistance, a disk-like sample of 10 mm diameter and 1 mm thickness is made at the same time with the above mentioned regular soft magnetic alloy particles.

Table 4 shows the insulation resistant values, the withstand voltages, and the maximum current values when driving in the 2-phase circuit system, using the above mentioned magnetic element, at the frequency of 800 kHz per one inductor coil and 30 A of DC superposed. The insulation resistance is measured in the way where both ends of the sample for measuring insulation resistance are kept with alligator clips and electric resistance is measured at 100 V. The insulation resistant rates in the table standardize the thus measured insulation resistance with the length and the cross sectional area of the sample. The electric resistance is measured by 100 V while heightening the voltage to 500 V, and the voltage when the resistance rapidly drops is obtained, and the withstand voltage is made by the voltage immediately before dropping. The maximum current value signifies the current value of DC superposed when the inductance value L is down by 20% at the current value of I=OA.

The evaluated results of these magnetic elements are shown in Table 4.

TABLE 4

| Sample No. | Filling factor (Volume %) | Insulation resistance (Ω · cm) | Withstand voltage (V) | Maximum current value (A) |
|---|---|---|---|---|
| 31 | 63 | $10^{12}$ | >500 | 27 |
| 32 | 65 | $10^{11}$ | >500 | 35 |
| 33 | 70 | $10^{10}$ | >500 | 42 |
| 34 | 85 | $10^{7}$ | 400 | 45 |
| 35 | 90 | $10^{5}$ | 200 | 48 |
| 36 | 92 | $10^{3}$ | <100 | 50 |

As apparently from Table 4, when the filling factor of the soft magnetic alloying particles is at most 90 volume %, the excellent property of DC superposed and the insulation resistant values are provided. If the filling factor is low, less than 65 volume %, the saturated magnetic flux density and the permeability are low, and sufficient inductance value or the property of DC superposed are not available. If the particles are charged so as not to be plastic-deformed an all, generally an upper limit of filling factor is 60 to 65 volume %, and too low saturated magnetic flux density and permeability are obtained with such filling factors. Accordingly, a filling degree to an extent of accompanying the plastic deformation is necessary, that is, the filling factor is at least 65 volume % is preferable, and more preferably it is at least 70 volume %.

On the other hand, if the occupancy of the alloy particle exceeds 90 volume %, a core insulation goes down, so that the insulation to the coil cannot be kept. Thus, the upper limit of the filling factor is set to be a range where the insulation resistance does not go down, but taking internally storing of the coil into consideration, the insulation resistant rate is necessary to be at least around $10^5$ Ω cm, and the filling factor of at most 90% is preferable, and more preferably at most 85%.

All the embodiments explained above employ the magnetic particles made of the metallic particles as the composite magnetic material. Using substances dispersed with the ferrite particles instead of the metallic particles, the saturated magnetic flux density is low and the property of DC superposed is inferior because of limiting the filling factor of ferrite.

Methods of producing the metallic particles include the water atomizer, gas atomizer, carbonyl process, or ingot pulverizer, but not especially depending on producing method. For main compositions of the respective metallic particles, impurities or additives are at small amounts, similar effects are brought about. Further, shapes of particles may be sphere, flat, polygonal or any other shapes.

In addition, in case the large current flows as DC superposed, not only loss in core portions but also loss (Copper loss) in coil conductors is not ignored. Therefore, for decreasing DC resistant values to the last, it is preferable in view of reliabilities to use the punched coil for providing such a structure without existence of connection between the coil portion and the terminals.

As to the insulation binding agent, from the viewpoint of strength after binding, heat resistance at use, or insulating property, such thermosetting resins as epoxy, phenol, silicon, or polyimide resins or the composite resin thereof are desirable.

For improving particle dispersion of the magnetic particles in the binding agent or with themselves, or for increasing withstand voltage, a dispersant or inorganic materials may be added. As such materials, particles of silane-based coupling material, titanium-based coupling material, titanium alkoxide, water glass, boron nitride, talc, mica, barium sulfate, or tetrafluoro-ethylene can be used.

INDUSTRIAL APPLICABILITY

In the multi-phase magnetic element of the present invention, plural coils are buried in a composite magnetic material, and there exist a negative coupling of magnetic fluxes or a positive coupling of magnetic fluxes between at least two coils. This structure more miniaturizes the multi-phase magnetic element. Further, dispersion of inductance values is far reduced within a magnetic substance, and as a result, a ripple current value is decreased. Besides, by the coupling of the magnetic fluxes, the multi-phase magnetic element has excellent properties of the ripple current or of DC superposed, being useful to the magnetic elements used to inductors, choke coils or others of electronic equipment.

The invention claimed is:

1. A magnetic element for multi-phase, comprising a coil with a winding axis in a straight line, the coil having a first end and a second end, a composite magnetic material buried within the coil, a first terminal provided intermediate the first end and the second end, the first terminal being exposed from the composite magnetic material, a second terminal provided at the first end, the second terminal being exposed from the composite magnetic material, and a third terminal provided at the second end, the third terminal being exposed from the composite magnetic material, wherein (1) a first part of the coil is disposed between the first terminal and the second terminal, (2) a second part of the coil is disposed between the first terminal and the third terminal, and (3) a coupling exists between a magnetic flux of the first part and a magnetic flux of the second part.

2. The magnetic element for multi-phase according to claim 1, wherein coupling of the magnetic fluxes is a negative coupling.

3. The magnetic element for multi-phase according to claim 1, wherein DC resistant-values of the first part and the second part are respectively at most 0.05 Ω.

4. The magnetic element for multi-phase according to claim 1, wherein the composite magnetic material contains soft magnetic alloy particles and an insulation binding agent.

5. The magnetic element for multi-phase according to claim 4, wherein the insulation binding agent is a thermo-setting resin.

6. The magnetic element for multi-phase according to claim 4, wherein the soft magnetic alloying particles contain iron, nickel and cobalt of at least 90 weight % in total.

7. The magnetic element for multi-phase according to claim 4, wherein the filling factor of the soft magnetic alloy particles is 65 to 90 volume %.

8. The magnetic element for multi-phase according to claim 4, wherein the average diameter of the soft magnetic alloy particles is at least 1 μm and at most 100 μm.

9. The magnetic element for multi-phase according to claim 1, wherein the coil is a punched coil integrally comprised of the second terminal and the third terminal.

* * * * *